United States Patent [19]

Kinishi et al.

[11] Patent Number: 4,605,940

[45] Date of Patent: Aug. 12, 1986

[54] THERMORESPONSIVE RECORDING PAPER SHEET

[75] Inventors: Ryoichi Kinishi, Fukuoka; Eisaburo Kaku, Niiza; Naoki Hanayama, Nakatsu, all of Japan

[73] Assignee: Yoshitomi Pharmaceutical Industries, Ltd., Osaka, Japan

[21] Appl. No.: 653,010

[22] PCT Filed: Jan. 17, 1983

[86] PCT No.: PCT/JP83/00015

§ 371 Date: Sep. 11, 1984

§ 102(e) Date: Sep. 11, 1984

[87] PCT Pub. No.: WO84/02882

PCT Pub. Date: Aug. 2, 1984

[51] Int. Cl.[4] ..... B41M 5/18

[52] U.S. Cl. ..... 346/209; 346/208; 346/221; 346/225; 427/150; 427/151

[58] Field of Search ..... 346/216, 225, 208, 209, 346/221; 427/150, 151, 152

[56] References Cited

U.S. PATENT DOCUMENTS 4,446,209 5/1984 Iwakura et al. ..... 346/216
4,453,744 6/1984 Würmli et al. ..... 346/216

FOREIGN PATENT DOCUMENTS 57-210886 2/1982 Japan .
0020493 2/1983 Japan ..... 346/216

*Primary Examiner*—Bruce H. Hess
*Attorney, Agent, or Firm*—Wenderoth, Lind & Ponack

[57] ABSTRACT

There is provided a thermoresponsive paper sheet comprising a normally colorless or pale-colored chromogenic substance in combination with a phenolic compound and the underlying paper substrate, said sheet further comprises a diether of the formula:

wherein $R^4$ is alkyl of 1 to 5 carbon atoms, benzyl or phenethyl.

8 Claims, 1 Drawing Figure

THERMORESPONSIVE RECORDING PAPER SHEET

TECHNICAL FIELD

This invention relates to a thermoresponsive recording paper sheet. More particularly, the invention relates to a thermoresponsive recording paper sheet with improved responsiveness in color production, weatherproofness and preservability.

BACKGROUND ART

It has long been known that colorless or pale-colored chromogenic substances, such as crystal violet lactone, and phenolic compounds can react to produce a color, and the use of such reaction in thermoresponsive paper sheet recording is disclosed in U.S. Pat. No. 3,539,375, for instance.

However, to meet the demands for higher thermal sensitivity and high-speed responsiveness, for instance, arising from recent advances in recording devices and diversified use of thermoresponsive recording sheets, it is still necessary to solve various problems. For instance, for use on thermal printers or thermal facsimile telegraphs, thermoresponsive paper sheets should have improved thermal responsiveness in color production, since an insufficient degree of responsiveness would result in increased electric power consumption and/or decreased printing velocity. For increasing color-producing responsiveness of thermoresponsive sheets, there has already been proposed the use of such additives as waxes (Japanese Patent Application laid open (Kokai) under No. 19,231/1973) and nitrogen-containing compounds (Japanese Kokai 34,842/1974).

In thermoresponsive recording sheets, presumably a chromogenic substance and a phenolic compound are present each in the stable and finely divided state dispersedly in the same layer or in different layers and, when heated, at least one of the two components melts or sublimates or both give an eutectic mixture, whereby they come into intimate contact with each other to produce a color. Therefore, it is necessary that each reactive color-developing component should be colorless or pale-colored crystals or solid at normal temperature, and further it is preferable that said component should melt at 70° C. or over and completely liquefy and/or vaporize at 150° to 200° C.

U.S. Pat. No. 3,539,375 describes as a phenolic compound adequate for such purpose 4,4'-isopropylidenediphenol, which is used today in many cases.

DISCLOSURE OF THE INVENTION

As a result of intensive research for a thermoresponsive recording paper sheet with improved responsiveness in color production, weather-proofness and preservability, the present inventors have accomplished this invention. Thus, the invention relates to a thermoresponsive recording paper sheet comprising a compound of the formula:

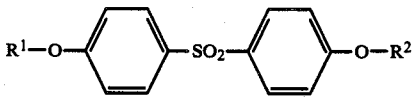

(I)

wherein $R^1$ is hydrogen, alkyl of 1 to 5 carbon atoms, benzyl or phenethyl, and $R^2$ is alkyl of 1 to 5 carbon atoms, benzyl or phenethyl, but $R^2$ does not represent methyl when $R^1$ is hydrogen.

DETAILED EXPLANATION OF THE INVENTION

In an aspect, this invention provides a thermoresponsive recording paper sheet comprising a normally colorless or pale-colored chromogenic substance and a phenolic compound of the formula:

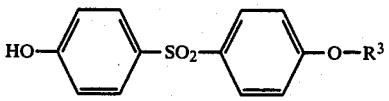

(I-a)

wherein $R^3$ is alkyl of 2 to 5 carbon atoms, benzyl or phenethyl.

The compound of formula (I-a) wherein $R^3$ is methyl is hardly crystallizable, and so it is unsuited for use in practicing the invention.

In another aspect, the invention provides a thermoresponsive recording paper sheet comprising a normally colorless or pale-colored chromogenic substance in combination with a phenolic compound, which further comprises a compound of the formula:

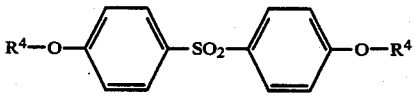

(I-b)

wherein $R^4$ is alkyl of 1 to 5 carbon atoms, benzyl or phenethyl.

The compound of formula (I-a) includes, for instance, 4-ethoxy-4'-hydroxydiphenyl sulfone, 4-propoxy-4'-hydroxydiphenyl sulfone, 4-isopropoxy-4'-hydroxydiphenyl sulfone, 4-butoxy-4'-hydroxydiphenyl sulfone, 4-isobutoxy-4'-hydroxydiphenyl sulfone, 4-tert-butoxy-4'-hydroxydiphenyl sulfone, 4-amyloxy-4'-hydroxydiphenyl sulfone, 4-isoamyloxy-4'-hydroxydiphenyl sulfone, 4-tert-amyloxy-4'-hydroxydiphenyl sulfone, 4-benzyloxy-4'-hydroxydiphenyl sulfone and 4-phenethyloxy-4'-hydroxydiphenyl sulfone.

The compound of formula (I-b) includes, for example, 4,4'-dimethoxydiphenyl sulfone, 4,4'-diethoxydiphenyl sulfone, 4,4'-dipropoxydiphenyl sulfone, 4,4'-dibutoxydiphenyl sulfone, 4,4'-diisobutoxydiphenyl sulfone, 4,4'-di-tert-butoxydiphenyl sulfone, 4,4'-diamyloxydiphenyl sulfone, 4,4'-diisoamyloxydiphenyl sulfone, 4,4'-di-tert-amyloxydiphenyl sulfone, 4,4'-dibenzyloxydiphenyl sulfone and 4,4'-diphenethyloxydiphenyl sulfone.

The 'chromogenic substance' as used herein means a compound capable of producing a color upon reaction with a phenolic compound and includes, among others, crystal violet lactone, malachite green lactone, 3,3-bis-(p-dimethylaminophenyl)-4,5,6,7-tetrachlorophthalide, benzo-β-naphthospiropyran, 3-methyl-di-β-naphthospiropyran, 1,3,3-trimethyl-6'-chloro-8'-methoxyindolinobenzospiropyran, N-phenylrhodamine lactam, 3-ethylamino-6-chlorofluoran, 3-morpholino-5,6-benzofluoran, 3-diethylamino-6-methyl-7-anilinofluoran, 3-diethylamino-6-methyl-7-chlorofluoran, 3-diethylamino-6,7-dimethylfluoran, 3-dimethylamino-7,8-benzofluoran, 3-diethylamino-6-methoxyfluoran, 3-diethylamino-7-dibenzylaminofluoran, 3-diethylamino-7-anilinofluoran, 3-diethylamino-5,6-benzo-7-benzylaminofluoran, 3-piperidino-6-methyl-7-anilinofluoran, 3-pyrrolidino-6-methyl-7-anilinofluoran, 3-N-ethyl.tolylamino-6-methyl-7-anilinofluoran and 3-diethylamino-7-(N-3-trifluoromethylphenyl)aminofluoran, but is not limited to these.

The phenolic compounds of formula (I-a) can be used in combination with another phenolic compound which liquefies or vaporizes generally at 70° C. or above and thereby reacts with the above-mentioned chromogenic substance to produce a color and includes, but is not limited to, 4-phenylphenol, 4-methyl-2,6-di-tert-butylphenol, 4,4'-dihydroxydiphenol, 4,4'-isopropylidenediphenol, 4,4'-isopropylidenebis(2-chlorophenol), 4,4'-isopropylidenebis(2-methylphenol), 4,4'-isopropylidenebis(2-tert-butylphenol), 4,4'-isopropylidenebis(2,6-dimethylphenol), 4,4'-sec-butylidenediphenol, 4,4'-cyclohexylidenediphenol, 4,4'-cyclohexylidenebis(2-methylphenol), 4,4'-cyclohexylidenebis(2-isopropylphenol), 2,2'-methylenebis(4-chlorophenol), 2,2'-methylenebis(4-methyl-6-tert-butylphenol), 2,2'-bis(4-hydroxyphenyl)hexane, 2,2'-bis(4-hydroxyphenyl)heptane, 2,2'-bis(4-hydroxyphenyl)octane, 4,4'-thiodiphenol, 4,4'-thiobis(3-methyl-6-tert-butylphenol), methyl p-hydroxybenzoate, ethyl p-hydroxybenzoate, benzyl p-hydroxybenzoate, tolylmethyl p-hydroxybenzoate, phenethyl p-hydroxybenzoate, 3-phenylpropyl p-hydroxybenzoate, phenyl p-hydroxybenzoate, 4-hydroxyacetophenone, 4-hydroxybenzophenone, salicylanilide, novolak type phenolic resin, halogenated novolak type phenolic resin, α-naphthol and β-naphthol, 2,2'-bis(4-hydroxyphenyl)-n-heptane.

In a thermoresponsive recording paper sheet comprising the compound of formula (I-b) as an agent for increasing responsiveness in color production, weatherproofness and preservability, the 'phenolic compound' as used herein means the compound of formula (I-a) and/or the above-mentioned another phenolic compound. The compound of formula (I-b) is used, for example, in an amount of 0.01 to 1 part by weight per part by weight of such phenolic compound.

The thermoresponsive recording paper sheet in accordance with the present invention can be prepared by a conventional method, for instance, (1) by comminuting the chromogenic substance and the phenolic compound (I-a) separately, if necessary together with a surfactant, binder and/or dispersing agent, in water or in an organic solvent, or (2) by comminuting the chromogenic substance, the phenolic compound and the compound of formula (I-b) each separately, or the chromogenic substance and the phenolic compound separately with the compound of formula (I-b) combined with the chromogenic substance and/or the phenolic compound, if necessary together with a surfactant, binder and/or dispersing agent, in water or in an organic solvent, in a crusher such as ball mill or sand grinder and coating a paper sheet with the resulting dispersions, followed by heat drying.

Some of compounds of formula (I) are described in Beilsteins Handbuch, and the compounds of formula (I) can be produced by alkylation of 4,4'-bisphenol sulfone. Typical examples of the compound of formula (I) are:

(1) 4-Ethoxy-4'-hydroxydiphenyl sulfone, m.p. 163°–164° C.
(2) 4-Propoxy-4'-hydroxydiphenyl sulfone, m.p. 138°–140.5° C.
(3) 4-Butoxy-4'-hydroxydiphenyl sulfone, m.p. 118°–119° C.
(4) 4-Benzyloxy-4'-hydroxydiphenyl sulfone, m.p. 162°–164° C.
(5) 4-Phenethyloxy-4'-hydroxydiphenyl sulfone, m.p. 143°–144° C.
(6) 4,4'-Dimethoxydiphenyl sulfone, m.p. 129°–130° C.
(7) 4,4'-Diethoxydiphenyl sulfone, m.p. 164° C.
(8) 4,4'-Dipropoxydiphenyl sulfone, m.p. 142°–143° C.
(9) 4,4'-Diisopropoxydiphenyl sulfone, m.p. 157° C.
(10) 4,4'-Dibutoxydiphenyl sulfone, m.p. 92.5° C.
(11) 4,4'-Diamyloxydiphenyl sulfone, m.p. 86.5° C.
(12) 4,4'-Diisoamyloxydiphenyl sulfone, m.p. 98° C.
(13) 4,4'-Dibenzyloxydiphenyl sulfone, m.p. 188°–189° C. and
(14) 4,4'-Diphenethyloxydiphenyl sulfone, m.p. 136°–138° C.

PREPARATIVE EXAMPLE 1

A mixture of 5 g of 4,4'-bisphenol sulfone, 40 ml of dimethyl sulfoxide, 1 g of sodium hydroxide and 2.7 g of propyl bromide is stirred at room temperature for 5 hours. The reaction mixture is then made acidic with hydrochloric acid and extracted with ethyl acetate. The extract is washed with aqueous hydrochloric acid and adjusted to pH 10 with aqueous sodium hydroxide to remove the unreacted starting materials which pass over into the aqueous layer. The organic layer is washed with aqueous hydrochloric acid and concentrated. The residue is crystallized from toluene to give 4-propoxy-4'-hydroxydiphenyl sulfone, melting at 138°–140.5° C.

PREPARATIVE EXAMPLE 2

A mixture of 5 g of 4,4'-bisphenol sulfone, 40 ml of methyl cellosolve, 1 g of sodium hydroxide and 4.1 g of phenethyl bromide is stirred at 90° C. for 5 hours. The reaction mixture is concentrated, and to the residue is added alkali until the pH of the aqueous layer reaches pH 10. The aqueous layer is extracted with ethyl acetate, and the extract is washed with aqueous hydrochloric acid and concentrated. The residue is crystallized from toluene to give 4-phenethyloxy-4'-hydroxydiphenyl sulfone, melting at 143°–144° C.

BRIEF EXPLANATION OF THE DRAWING

In FIG. 1, curve (1) is for the thermoresponsive recording paper sheet of Comparative Example 1, curve (2) for that of Example 6, curve (3) for that of Example 7, and curve (4) for that of Example 8.

Figure 1:
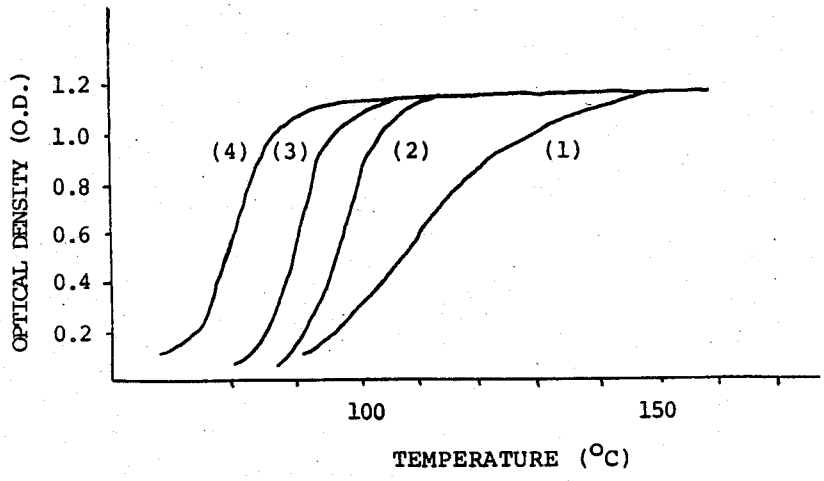
FIG. 1 shows the temperature-dependency of the optical density as measured with a photoelectric densitometer.

The present invention will be better understood from the following examples, but they are not to be construed as limiting the present invention. 'Part(s) means 'part(s) by weight'.

COMPARATIVE EXAMPLE 1

| | |
|---|---|
| Dispersion A: | |
| Crystal violet lactone | 1 part |
| 5% Polyvinyl alcohol solution | 5 parts |
| Water | 40 parts |
| Dispersion B: | |
| 4,4'-Isopropylidenediphenol | 5 parts |
| 5% Polyvinyl alcohol solution | 25 parts |
| Water | 20 parts |

COMPARATIVE EXAMPLE 2

| | |
|---|---|
| Dispersion A: | |
| Same as Dispersion A in Comparative Example 1 | 46 parts |
| Dispersion B: | |
| 4,4'-Butylidenebis(6-tert-butyl-m-cresol) | 5 parts |
| 5% Polyvinyl alcohol solution | 25 parts |
| Water | 20 parts |

EXAMPLE 1

| | |
|---|---|
| Dispersion A: | |
| Same as Dispersion A in Comparative Example 1 | 46 parts |
| Dispersion B: | |
| 4-Propoxy-4'-hydroxydiphenyl sulfone | 5 parts |
| 5% Polyvinyl alcohol solution | 25 parts |
| Water | 20 parts |

EXAMPLE 2

| | |
|---|---|
| Dispersion A: | |
| Same as Dispersion A in Comparative Example 1 | 46 parts |
| Dispersion B: | |
| 4-Ethoxy-4'-hydroxydiphenyl sulfone | 5 parts |
| 5% Polyvinyl alcohol solution | 25 parts |
| Water | 20 parts |

EXAMPLE 3

| | |
|---|---|
| Dispersion A: | |
| Same as Dispersion A in Comparative Example 1 | 46 parts |
| Dispersion B: | |
| 4-Butoxy-4'-hydroxydiphenyl sulfone | 5 parts |
| 5% Polyvinyl alcohol solution | 25 parts |
| Water | 20 parts |

EXAMPLE 4

| | |
|---|---|
| Dispersion A: | |
| Same as Dispersion A in Comparative Example a | 46 parts |
| Dispersion B: | |
| 4-Benzyloxy-4'-hydroxydiphenyl sulfone | 5 parts |
| 5% Polyvinyl alcohol solution | 25 parts |
| Water | 20 parts |

EXAMPLE 5

| | |
|---|---|
| Dispersion A: | |
| Same as Dispersion A in Comparative Example 1 | 46 parts |
| Dispersion B: | |
| 4-Phenethyloxy-4'-hydroxydiphenyl sulfone | 5 parts |
| 5% Polyvinyl alcohol solution | 25 parts |
| Water | 20 parts |

EXAMPLE 6

| | |
|---|---|
| Dispersion A: | |
| Same as Dispersion A in Comparative Example 1 | 46 parts |
| Dispersion B: | |
| 4,4'-Isopropylidenediphenol | 4 parts |
| 4,4'-Dibutoxydiphenyl sulfone | 1 part |

-continued

| | |
|---|---|
| 5% Polyvinyl alcohol solution | 25 parts |
| Water | 20 parts |

EXAMPLE 7

| | |
|---|---|
| Dispersion A: | |
| Same as Dispersion A in Comparative Example 1 | 46 parts |
| Dispersion B: | |
| 4-Propoxy-4'-hydroxydiphenyl sulfone | 4.75 parts |
| 4,4'-Diamyloxydiphenyl sulfone | 0.25 parts |
| 5% Polyvinyl alcohol solution | 25 parts |
| Water | 20 parts |

EXAMPLE 8

| | |
|---|---|
| Dispersion A: | |
| Same as Dispersion A in Comparative Example 1 | 46 parts |
| Dispersion B: | |
| 4-Butoxy-4'-hydroxydiphenyl sulfone | 4 parts |
| 4,4'-Dibutoxydiphenyl sulfone | 1 part |
| 5% Polyvinyl alcohol solution | 25 parts |
| Water | 20 parts |

In each of the above examples, Dispersions A and B were prepared separately (i.e. without mixing Dispersion A with Dispersion B) by dispersing the solid component by grinding in a ball mill for 2 days and then combined to give a coating composition for making a thermoresponsive recording paper sheet. A sheet of fine quality paper having the basis weight of 50 g/m$^2$ was coated on one side with the coating composition to the coat amount of 4 g/m$^2$ (on the dried basis) and dried at 50° C. in a drier. The thermoresponsive paper sheet thus obtained was caused to produce a color by pressing the sheet against a plate heated at 80°–150° C. under the pressure of 1.5 kg/cm$^2$ (gauge) for 5 seconds.

The thermoresponsive recording paper sheets of Examples 1 to 5 and Comparative Examples 1 and 2 were tested for the responsiveness and the preservability of recorded images. The results are shown in Table 1. The thermoresponsive recording paper sheets of Examples 6 to 8 and Comparative Example 1 were measured for the intensity of color using a photoelectric densitometer. The results are shown in FIG. 1.

TABLE 1

| | Responsiveness in Recording | Discoloration of Recorded Images* |
|---|---|---|
| Example 1 | ++ | ++ |
| Example 2 | + | ++ |
| Example 3 | ++ | ++ |
| Example 4 | + | ++ |
| Example 5 | ++ | ++ |
| Comparative Example 1 | + | + |
| Comparative Example 2 | − | − |

*After storing at normal temperature for 24 hours Responsiveness:
++: Excellent
+: Fair
−: Poor
Discoloration of Recorded Images:
++: No discoloration
+: Moderate discoloration
−: The image almost disappeared.

EXAMPLE 9

In dispersions B in Example 6 and Example 8, the proportion of 4,4'-dibutoxydiphenyl sulfone to the phenolic compound was varied as specified below in Table 2 while the total amount of the two components was retained, and thermoresponsive recording paper sheets were prepared in the same manner as mentioned above.

TABLE 2

| | Thermoresponsive Sheet No. | | | | | | | | | |
|---|---|---|---|---|---|---|---|---|---|---|
| Compound | 1 | 2 | 3 | 4 | 5 | 6 | 7 | 8 | 9 | 10 |
| Compound A | 2 | 2 | 2 | 1 | 1 | 1 | 0.5 | 0.5 | 0.5 | 0 |
| Phenol I | 3 | | | 4 | | | 4.5 | | | 5 |
| Phenol II | | 3 | | | 4 | | | 4.5 | | |
| Phenol III | | | 3 | | | 4 | | | 4.5 | |

Compound A: 4,4'-Dibutoxydiphenyl sulfone
Phenol I: 4,4'-Isopropylidenediphenol
Phenol II: Benzyl p-hydroxybenzoate
Phenol III: 4-Butoxy-4'hydroxydiphenyl sulfone When recording was carried out on a thermal printer, the thermoresponsive recording paper sheets Nos. 1–9 produced distinct images with good preservability at high degree of dynamic responsiveness.

EXAMPLE 10

| | |
|---|---|
| Dispersion A: | |
| 3-Diethylamino-6-methyl-7-anilinofluoran | 1 part |
| 5% Polyvinyl alcohol solution | 5 parts |
| Water | 40 parts |
| Dispersion B: | |
| Same as Dispersion B in Example 3 | 50 parts |

EXAMPLE 11

| | |
|---|---|
| Dispersion A: | |
| Same as Dispersion A in Example 10 | 46 parts |
| Dispersion B: | |
| Same as Dispersion B in Example 6 | 50 parts |

Using Dispersions A and B of Example 10 or 11, thermoresponsive recording paper sheets were prepared in the same manner as mentioned above. The sheets, when recording was performed by means of a thermal printer, gave distinct images with good preservability at high degree of responsiveness in color production.

What is claimed is:

1. A thermoresponsive recording paper sheet comprising a normally colorless or pale-colored chromogenic substance in combination with a phenolic compound and the underlying paper substrate, said sheet further comprises a diether of the formula:

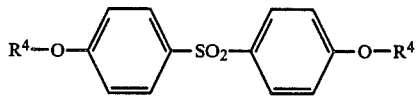

wherein $R^4$ is alkyl of 1 to 5 carbon atoms, benzyl or phenethyl.

2. The thermoresponsive recording paper sheet according to claim 1, wherein the diether compound is 4,4'-dibutoxydiphenyl sulfone.

3. The thermoresponsive recording paper sheet according to claim 1, wherein the phenolic compound is 4,4'-isopropylidenediphenol.

4. The thermoresponsive recording paper sheet according to claim 1, wherein the phenolic compound is benzyl p-hydroxybenzoate.

5. The thermoresponsive recording paper sheet according to claim 1, wherein the phenolic compound is 4-butoxy-4'-hydroxydiphenyl sulfone.

6. The thermoresponsive recording paper sheet according to claim 1, wherein the chromogenic substance is a fluoran compound.

7. The thermoresponsive recording paper sheet according to claim 6, wherein the fluoran compound is 3-diethylamino-6-methyl-7-anilinofluoran.

8. The thermoresponsive recording paper sheet according to claim 1, wherein the chromogenic substance is crystal violet lactone.

* * * * *